US010674250B2

(12) United States Patent
Wang et al.

(10) Patent No.: US 10,674,250 B2
(45) Date of Patent: Jun. 2, 2020

(54) SPEAKER BOX

(71) Applicant: AAC ACOUSTIC TECHNOLOGIES (SHENZHEN) CO., LTD., Shenzhen (CN)

(72) Inventors: Yanlong Wang, Shenzhen (CN); Fuhu Zhang, Shenzhen (CN)

(73) Assignee: AAC Acoustic Technologies (Shenzhen) Co., Ltd., Shenzhen, Guangdong (CN)

( * ) Notice: Subject to any disclaimer, the term of this patent is extended or adjusted under 35 U.S.C. 154(b) by 0 days.

(21) Appl. No.: 16/527,060

(22) Filed: Jul. 31, 2019

(65) Prior Publication Data

US 2020/0045413 A1 Feb. 6, 2020

(30) Foreign Application Priority Data

Aug. 3, 2018 (CN) ..... 2018 1 0877779

(51) Int. Cl.
*H04R 1/28* (2006.01)
*H04R 1/02* (2006.01)
*H04R 31/00* (2006.01)

(52) U.S. Cl.
CPC ..... *H04R 1/2811* (2013.01); *H04R 1/025* (2013.01); *H04R 1/288* (2013.01); *H04R 31/00* (2013.01); *H04R 2499/11* (2013.01)

(58) Field of Classification Search
CPC ..... H04R 1/2811; H04R 31/00; H04R 1/288; H04R 1/025; H04R 2499/11; H04R 1/2857; H04R 1/023; H04R 1/2807; H04R 1/2873; H04R 1/2876
See application file for complete search history.

(56) References Cited

U.S. PATENT DOCUMENTS 9,838,765 B1 * 12/2017 Li ..... H04R 1/023
2007/0147645 A1 * 6/2007 Kuze ..... H04R 1/2819 381/337
2007/0286449 A1 * 12/2007 Matsumura ..... H04R 1/2803 381/433

* cited by examiner

*Primary Examiner* — Brian Ensey
(74) *Attorney, Agent, or Firm* — W&G Law Group LLP

(57) ABSTRACT

The present disclosure discloses a speaker box which includes an upper cover, a lower cover fixed to the upper cover in a covering manner and forming an accommodating space with the lower cover, and a sound unit accommodated in the accommodating space. The sound unit and the upper cover define a front cavity. The sound unit, the lower cover and the upper cover define a rear cavity together. The speaker box further includes a cover plate fixed to one side of the upper cover away from the lower cover, and an air-permeable isolating member. The cover plate and the upper cover are separated and define an auxiliary cavity which is filed with sound-absorbing particles. The air-permeable isolating member is fixed to the upper cover and completely covers the through hole, and the air-permeable isolating member encloses the sound-absorbing particles in the auxiliary cavity.

12 Claims, 4 Drawing Sheets

SPEAKER BOX

TECHNICAL FIELD

The present disclosure relates to acoustoelectric technology, and particularly relates to a speaker box applied to a portable electronic product.

BACKGROUND

With an advent of a mobile Internet era, the number of smart mobile devices is increasingly rising. Among various mobile devices, mobile phones are undoubtedly the most common and portable mobile terminal devices. Currently, functions of mobile phones are extremely diverse, and one thereof is a high-quality music function. Thus speaker boxes for playing sound are widely used in the present smart mobile devices.

A speaker box in a related technology includes an upper cover, a lower cover fixed to the upper cover in a covering manner and forming an accommodating space with the lower cover, a sound unit and an air-permeable isolating member accommodated in the accommodating space, and a baffle wall formed in the accommodating space. The sound unit and the upper cover define a front cavity. The sound unit, the lower cover and the upper cover define a rear cavity. The baffle wall divides the rear cavity into a first rear cavity and a second rear cavity that are in communication with each other. The second rear cavity is filled with sound-absorbing particles, and the sound-absorbing particles are enclosed in the second rear cavity by the air-permeable isolating member.

However, in the related technology, the second rear cavity of the speaker box is located on one side of the first rear cavity, but does not extend to the side of the front cavity away from the lower cover. Therefore, for a speaker box with a thick core region, a space at the side of the front cavity away from the lower cover is left unused, which is a waste of space.

Therefore, it is necessary to provide a new speaker box to solve the above-described technical problem.

BRIEF DESCRIPTION OF THE DRAWINGS

In order to describe technical solutions in embodiments of the present disclosure more clearly, accompanying drawings which are used to describe the embodiments are briefly illustrated below. Obviously, the drawings in the following description are only some embodiments of the present disclosure. Skilled persons in the art may obtain other drawings according to these drawings without creative efforts.

DETAILED DESCRIPTION

Technical solutions in embodiments of the present disclosure will be clearly and completely described with reference to accompany drawings of the present disclosure. Obviously, the described embodiments are only some embodiments rather than all embodiments of the present disclosure. Based on the embodiments of the present disclosure, all other embodiments obtained by skilled persons in the art without making any creative efforts fall into the protection scope of the present disclosure.

Figure 1:
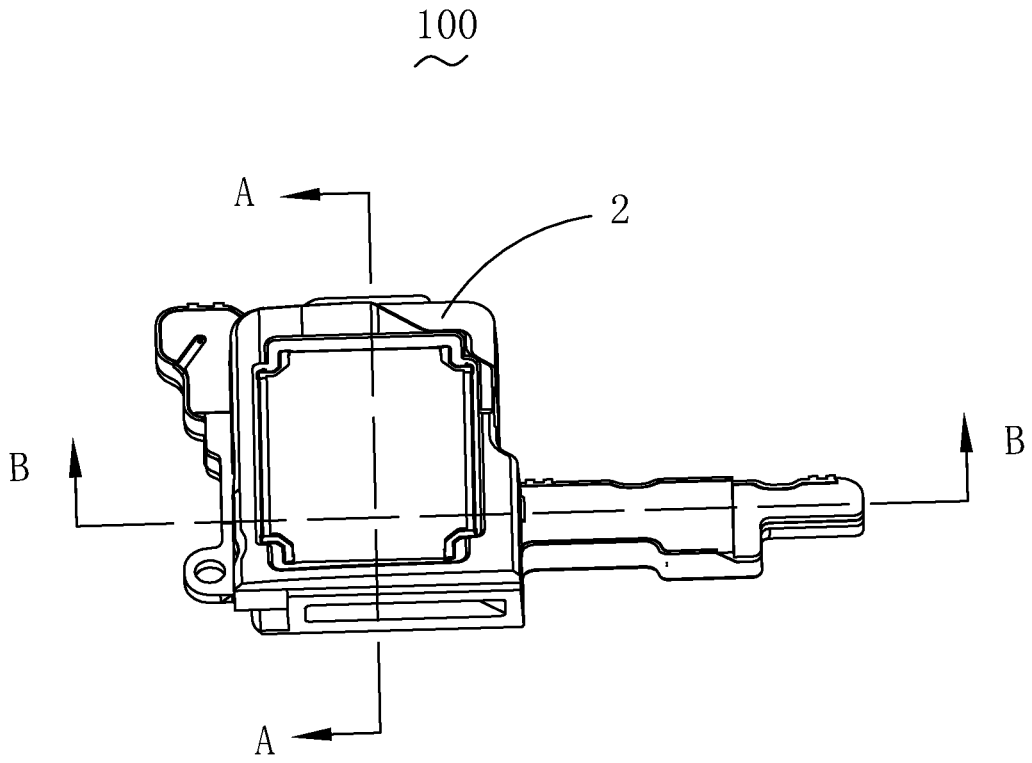
FIG. 1 is a schematic perspective view of a speaker box in the present disclosure.
Figure 2:
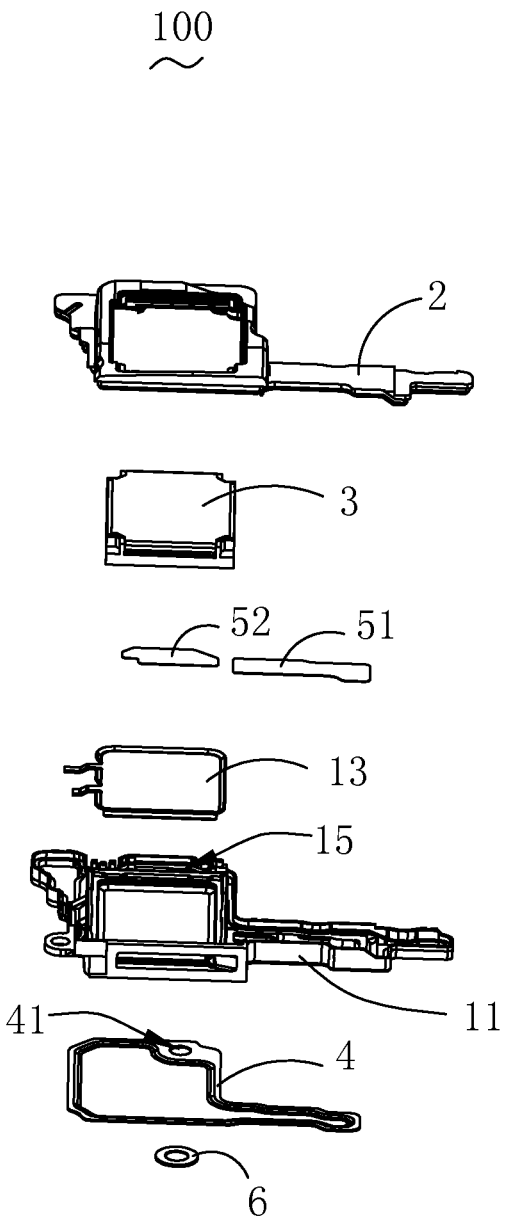
FIG. 2 is a perspective exploded view of FIG. 1.
Figure 3:
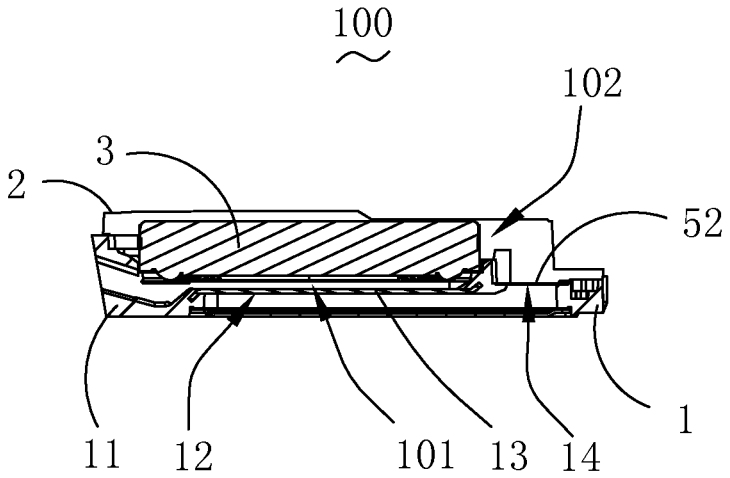
FIG. 3 is a cross-sectional view along an A-A line shown in FIG. 1.
Figure 4:
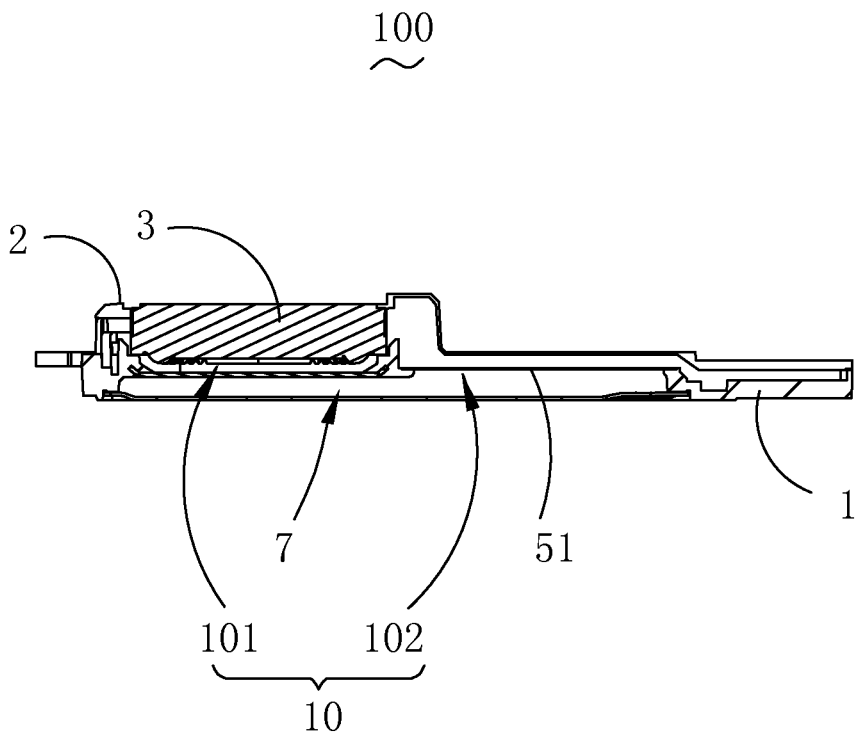
FIG. 4 is a cross-sectional view along a B-B line shown in FIG. 1.

With reference to FIGS. 1-4, a speaker box 100 includes an upper cover 1, a lower cover 2, a sound unit 3, a cover plate 4 and an air-permeable isolating member.

The lower cover 2 is fixed to the upper cover 1 in a covering manner and forms an accommodating space 10 with the lower cover 2. The sound unit which is configured to sound is accommodated in the accommodating space 10. The sound unit 3 has a diaphragm. The upper cover 1 faces to the diaphragm. The sound unit 3 divides the accommodating space 10 into a front cavity 101 and a rear cavity 102. The front cavity 101 is formed between the diaphragm and the upper cover 1. The rear cavity 102 is configured to improve low-frequency acoustic performance. The cover plate 4 is fixed to one side of the upper cover 1 away from the lower cover 2. The cover plate 4 and the upper cover 1 are separated and define an auxiliary cavity 7 which is filed with sound-absorbing particles which may be, for example, zeolite particles.

The upper cover 1 is disposed with a through hole that penetrates through the upper cover and that communicates the rear cavity 102 and the auxiliary cavity 7. The air-permeable isolating member is fixed to the upper cover 1 and completely covers the through hole. The air-permeable isolating member encloses the sound-absorbing particles in the auxiliary cavity 7.

In this embodiment, the speaker box 100 further includes a powder-filling hole 41 and a sealing cover 6. The powder-filling hole 41 penetrates through the cover plate 4. The sealing cover 6 is fixed to the cover plate 4 and covers the powder-filling hole 41 in communication with the auxiliary cavity 7. The sound-absorbing particles fill the auxiliary cavity 7 through the powder-filling hole 41.

As one embodiment of the present disclosure, the cover plate 4 is made of steel and is integrally injection-molded with the upper cover 1.

As another embodiment of the present disclosure, the cover plate 4 is made of steel and is adhesively fixed to the upper cover 1. As further another embodiment of the present disclosure, the cover plate 4 is an injection-molded plate with a steel insert 13 and is fixed to the upper cover 1 through ultrasonic welding.

In this embodiment, the upper cover 1 includes an upper cover body 11, a penetration portion 12 through the upper cover body 11, and a steel sheet 13 fixed to the upper cover body 11 and completely covering the penetration portion 12. The steel sheet 13 is disposed opposite to the cover plate 4 and faces to the diaphragm.

In this embodiment, the upper cover 1 includes a top wall facing to the diaphragm and a side wall extending from the top wall towards the lower cover. The side wall is disposed with a sound outlet in communication with the front cavity.

In this embodiment, the through hole at least includes a first through hole 14 and a second through hole 15 which are disposed separately from each other. The air-permeable isolating member includes a first air-permeable isolating member 51 which covers the first through hole 14 and a second air-permeable isolating member 52 which covers the second through hole 15 respectively. The first air-permeable isolating member 51 and the second air-permeable isolating member 52 are fixed to one side of the upper cover 1 close to the rear cavity 102. This structure is advantageous for improving air flow. The first air-permeable isolating member 51 and the second air-permeable isolating member 52 are configured to communicate a first rear cavity 1021 with a second rear cavity 1022 through pores, so that air may flow between the first rear cavity 1021 and the second rear cavity 1022.

Compared with a related technology, the first rear cavity and the second rear cavity of the speaker box are in communication with each other through a plurality of air-permeable isolating members, so that air may flow between the first rear cavity and the second rear cavity. The air-permeable isolating members are located on surrounding sides of the upper cover body facing to the front cavity, which is advantageous for improving air flow. With respect to the speaker box in the present disclosure, through reasonable layout, the second rear cavity which is configured to be filled with sound-absorbing particles extends below the front cavity, so that a volume of the second rear cavity is enlarged and audio performance of the speaker box is improved.

The above-described are only embodiments of the present disclosure. It should be noted that skilled persons in the related art may make improvements without departing from the concept of the present disclosure. All these improvements fall into the protection scope of the present disclosure.

What is claimed is:

1. A speaker box, comprising an upper cover, a lower cover fixed to the upper cover in a covering manner and forming an accommodating space with the lower cover, and a sound unit accommodated in the accommodating space, wherein the sound unit has a diaphragm, the upper cover faces to the diaphragm, and the sound unit divides the accommodating space into a front cavity formed between the diaphragm and the upper cover, and a rear cavity defined by the sound unit, the lower cover and the upper cover combined, wherein the speaker box further comprises a cover plate fixed to one side of the upper cover away from the lower cover and an air-permeable isolating member, and the cover plate and the upper cover are separated and defines an auxiliary cavity which is filed with sound-absorbing particles, wherein the upper cover is disposed with a through hole that penetrates through the upper cover and that communicates the rear cavity with the auxiliary cavity, and wherein the air-permeable isolating member is fixed to the upper cover and completely covers the through hole, and the air-permeable isolating member encloses the sound-absorbing particles in the auxiliary cavity.

2. The speaker box according to claim 1, wherein the speaker box further comprises a powder-filling hole disposed through the cover plate and a sealing cover fixed to the cover plate and covering the powder-filling hole, the powder-filling hole is in communication with the auxiliary cavity, and the sound-absorbing particles fills the auxiliary cavity through the powder-filling hole.

3. The speaker box according to claim 1, wherein the cover plate is made of steel and integrally injection-molded with the upper cover.

4. The speaker box according to claim 1, wherein the cover plate is made of steel and adhesively fixed to the upper cover.

5. The speaker box according to claim 1, wherein the cover plate is an injection-molded plate with a steel insert and is fixed to the upper cover through ultrasonic welding.

6. The speaker box according to claim 3, wherein the upper cover comprises an upper cover body, a penetration portion penetrating through the upper cover body, and a steel sheet fixed to the upper cover body and completely covering the penetration portion, and the steel sheet is disposed opposite to the cover plate and faces to the diaphragm.

7. The speaker box according to claim 4, wherein the upper cover comprises an upper cover body, a penetration portion penetrating through the upper cover body, and a steel sheet fixed to the upper cover body and completely covering the penetration portion, and the steel sheet is disposed opposite to the cover plate and faces to the diaphragm.

8. The speaker box according to claim 5, wherein the upper cover comprises an upper cover body, a penetration portion penetrating through the upper cover body, and a steel sheet fixed to the upper cover body and completely covering the penetration portion, and the steel sheet is disposed opposite to the cover plate and faces to the diaphragm.

9. The speaker box according to claim 1, wherein the upper cover comprises a top wall facing to the diaphragm and a side wall extending from the top wall towards the lower cover, and the side wall is disposed with a sound outlet in communication with the front cavity.

10. The speaker box according to claim 1, wherein the through hole at least comprises a first through hole and a second through hole which are disposed separately from each other, and the air-permeable isolating member comprises a first air-permeable isolating member which covers the first through hole and a second air-permeable isolating member and which covers the second through hole respectively.

11. The speaker box according to claim 10, wherein the first air-permeable isolating member and the second air-permeable isolating member are fixed to one side of the upper cover close to the rear cavity.

12. The speaker box according to claim 10, wherein the first air-permeable isolating member and the second air-permeable isolating member are fixed to the upper cover through injection molding, hot melting, or adhesive.

* * * * *